United States Patent [19]

Peterson

[11] 4,037,771

[45] July 26, 1977

[54] FASTENER DRIVING APPARATUS UTILIZING HIGH CAPACITY FASTENER PACKAGE

[75] Inventor: William J. Peterson, Coventry, R.I.

[73] Assignee: Textron, Inc., Providence, R.I.

[21] Appl. No.: 662,954

[22] Filed: Mar. 1, 1976

[51] Int. Cl.[2] ..... B25C 1/04

[52] U.S. Cl. ..... 227/130; 227/136; 206/346

[58] Field of Search ..... 227/114, 115, 116, 136, 227/137, 138, 139, 130; 206/343, 344, 345, 346

[56] References Cited

U.S. PATENT DOCUMENTS

| | | | |
|---|---|---|---|
| 2,498,503 | 2/1950 | Papalia | 227/137 |
| 3,330,462 | 7/1967 | Colechia et al. | 227/136 |
| 3,587,842 | 6/1971 | Keck | 206/346 |
| 3,707,406 | 12/1972 | Perkins | 227/136 |

*Primary Examiner*—Granville Y. Custer, Jr.
*Attorney, Agent, or Firm*—Cushman, Darby & Cushman

[57] ABSTRACT

Apparatus for driving successive fasteners from a package of generally parallel fasteners flexibly serially interconnected in general row formation having a total virgin package weight greatly in excess of that which could be practically manually handled, the apparatus comprising a portable power operated fastener driving device of the type operable to be manually handled by an operator within a workpiece containing limited space, a rotary tray for supporting a coiled package of fasteners at a location spaced horizontally from the limited space within which the device is to be manually handled, and an elongated guide track of a horizontal extent sufficient to extend from the location of the rotary tray to the limited space within which the device is to be manually handled, the guide track being supported at one end in cooperating relation with the rotary tray and connected at its other end with the device for movement thereby in response to the manual handling movement of the device, the supported connection of the one end of the guide track being operable to accommodate any movements imparted to the other end of the guide track by the manual handling movements of the device whereby such manual handling movements can be accomplished by the operator while supporting only a proportionate share of the weight of the guide track and a leading length of the fastener package extending from the rotary tray through the guide track and into cooperating relation with the fastener feeding mechanism of the device.

31 Claims, 7 Drawing Figures

FASTENER DRIVING APPARATUS UTILIZING HIGH CAPACITY FASTENER PACKAGE

This invention relates to fastener driving apparatus and more particularly to apparatus of this type capable of driving fasteners from a large capacity package of generally parallel fasteners flexibly serially interconnected in general row formation.

Fastener packages embodying a multiplicity of general parallel fasteners (e.g. headed nails) flexible serially interconnected in general row formation are known. Examples of fastener packages of this type are disclosed in the following U.S. Pat. Nos. 2,784,405; 2,982,595; 3,083,369; 3,357,761; 3,410,620; 3,442,374; 3,463,304; 3,515,271; 3,538,673; 3,587,842; and 3,707,406.

Heretofore the size of a virgin fastener package was limited in total weight to an amount which could be practically manually handled with the fastener driving device used to drive successive fasteners of the package. Fastener driving devices of this type are well known and have come into increasingly widespread use in recent years. One of the fundamental advantages of devices of this type resides in the portable nature of the device, that is, that it can be conveniently manually handled. Such devices are often manually handled in relatively limited spaces where the workpieces are moved past a fastener station, thus requiring the operator to effect the driving of a large number of fasteners without the necessity of moving the fastener driving device beyond a limited space. Many situations of this type exist in various assembly lines for products requiring components to be fastened by nails. In situations of this type large numbers of fasteners are driven in a relatively short period of time, requiring the operator to expend considerable time in reloading the magazine of the device with new fastener packages. Considerable saving could thus be effected if apparatus of this type could be provided with the capability of being conveniently manually handled within such a workpiece containing limited space, with the fastener feeding means of the device operating on a package having a total virgin package weight greatly in excess of that which could be practically manually handled with the device.

An object of the present invention is to provide apparatus having such capability. In accordance with the principles of the present invention, this objective is obtained by providing means for supporting such a package of fasteners at a location spaced horizontally from the limited space within which the device is to be manually handled and a movable elongated bridge means connected between the package support means and the device so as to accommodate the manual handling of the device within the limited space, such movable bridge means having fastener support means extending longitudinally therealong for supporting a leading length of fasteners in general row formation extending from the location of the package support. In this way, the leading portion of the fastener package is guidingly moved to and by the fastener feeding means of the fastener driving device in a controlled manner which enables the operator to effect the manual handling of the device within the space while supporting only a proportionate share of the weight of the bridge and the length of the fastener package supported thereon.

By limiting the longitudinal extent of the bridge structure, the proportional share of the weight of the bridge and length of fastener package supported thereon can be limited to that which can be practically handled by the operator. With this arrangement, it is possible to provide for the remote support of a fastener package containing two to three thousand nails and more having a total weight in excess of 25 pounds.

Another object of the present invention is the provision of apparatus of the type described which is effective in operation, simple in construction and economical to manufacture and maintain.

These and other objects of the present invention will become more apparent during the course of the following detailed description and appended claims.

The invention may best be understood with reference to the accompanying drawings wherein an illustrative embodiment is shown.

Figure 1:
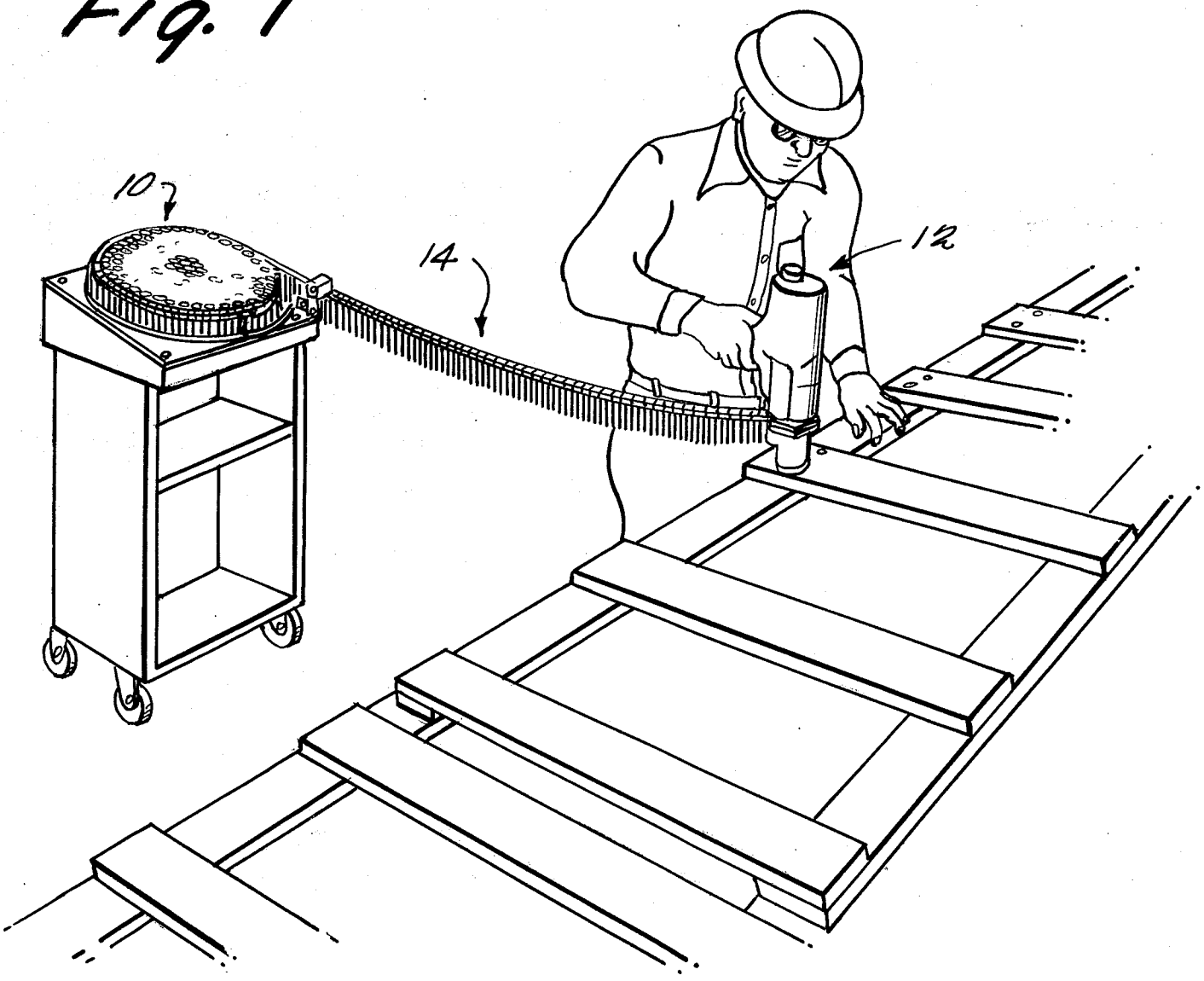
FIG. 1 is a schematic perspective view of an apparatus embodying the principles of the present invention, illustrating the apparatus in operation.

Referring now more particularly to FIG. 1 of the drawings, there is shown therein a pictorial representation of apparatus embodying the principles of the present invention showing the same in a preferred operative position. The apparatus comprises three main components: a high capacity fastener package supporting assembly, generally indicated at 10; a fastener driving device of known construction, generally indicated at 12; and a bridge assembly, generally indicated at 14, operatively extending between the fastener package support assembly and the fastener driving device for guidingly supporting the leading length of the fastener package from the package support assembly 10 to the device 12. The bridge assembly 14 enables the device 12 to be manually handled within a workpiece containing limited space by an operator in such a way that the operator need support only a proportionate share of the weight of the bridge assembly 14 and the length of the fastener package supported thereon. This basic relationship is illustrated in FIG. 1.

Figure 3:
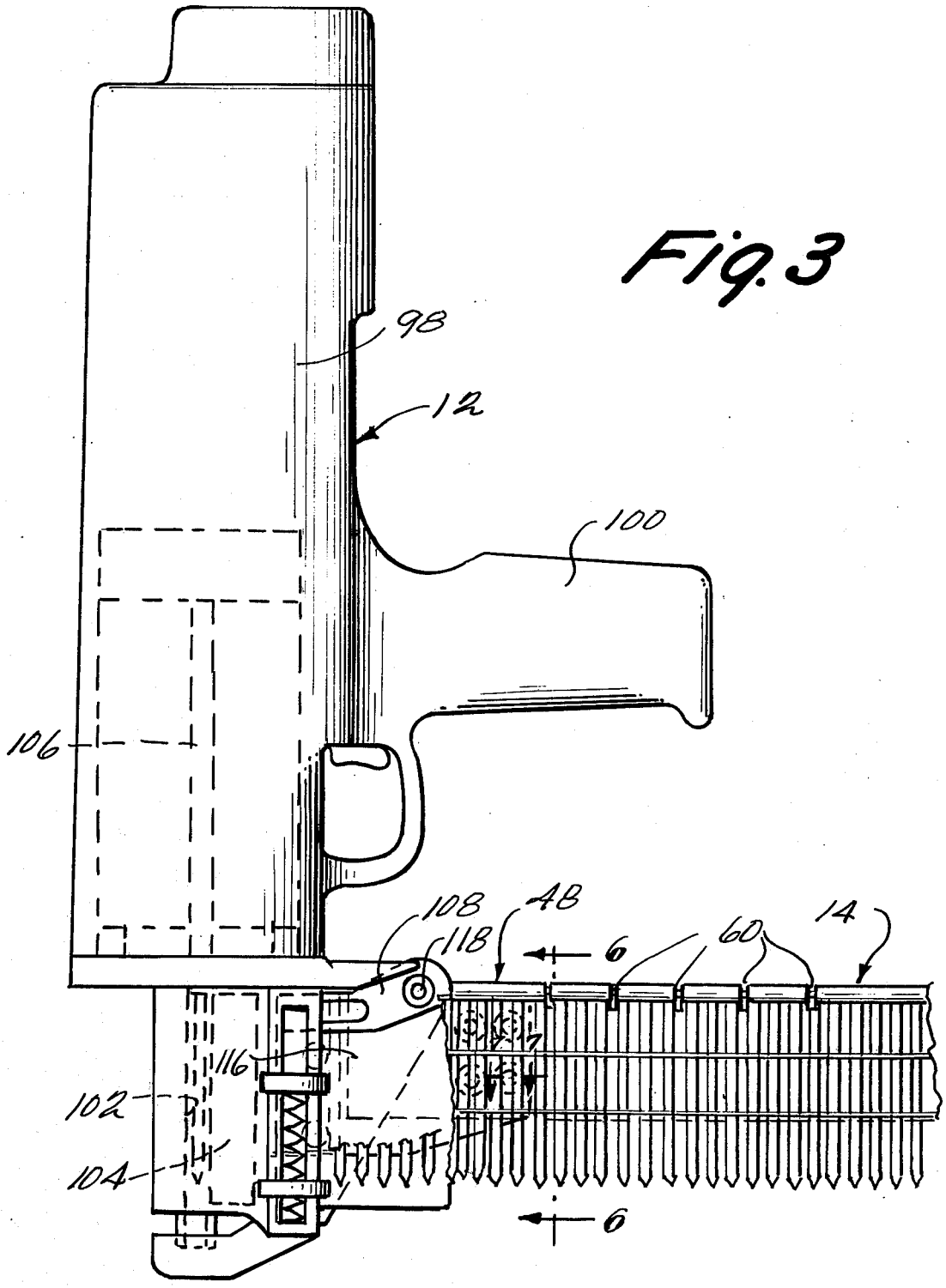
FIG. 3 is a fragmentary side elevational view of the apparatus showing the fastener driving device and a cooperating portion of the bridge assembly.

The particular construction of each of the three components of the present apparatus will be dependent upon the particular construction of the fastener package contemplated for use therewith. As previously indicated, the present invention contemplates the utilization of any of the fastener package configurations known in the prior art, as, for example, any of the configurations disclosed in the patents listed heretofore. For purposes of illustrating a preferred exemplary embodiment, a fastener package constructed in accordance with my U.S. Pat. No. 3,083,369 issued Apr. 2, 1963, is shown. Conically coiled fastener packages such as illustrated in FIG. 3 of this patent have been commercially available for several years. Two examples of commercial packages are a package of 300 common 6 penny nails, and a package of 250 common 8 penny nails. In accordance with the principles of the present invention, the same nails and package configuration would be utilized but the size of the package would be increased in terms of the number of nails by approximately ten-fold or more. Thus, the present invention would contemplate a package of 3,000 6 penny common nails or a package of 2,500 8 penny nails. The above figures are believed sufficient to exemplify the magnitude of the package contemplated in accordance wth the principles of the present invention.

Since, as indicated above, the preferred nail package comprises a conical coil of headed nails disposed generally parallel with respect to each other and flexibly serially interconnected in substantial row formation by a pair of weld wires or the like, the package supporting assembly 10 is structured to accommodate a package of this type and the device 12 is of known construction provided for driving the aforesaid commercial packages of nails of the type embodied in the present large capacity package. The device 12 is disclosed in U.S. Pat. Nos. 3,259,292; 3,330,462; and 3,628,715; the disclosure of each of which is hereby incorporated by reference into the present specification. The device 12 utilized with the present invention is constructed in accordance with these three patents except for the modifications hereinafter stated. Likewise, the bridge assembly 14 is constructed to cooperate with and guidingly support the fasteners in the preferred package form as aforesaid.

Figure 2:
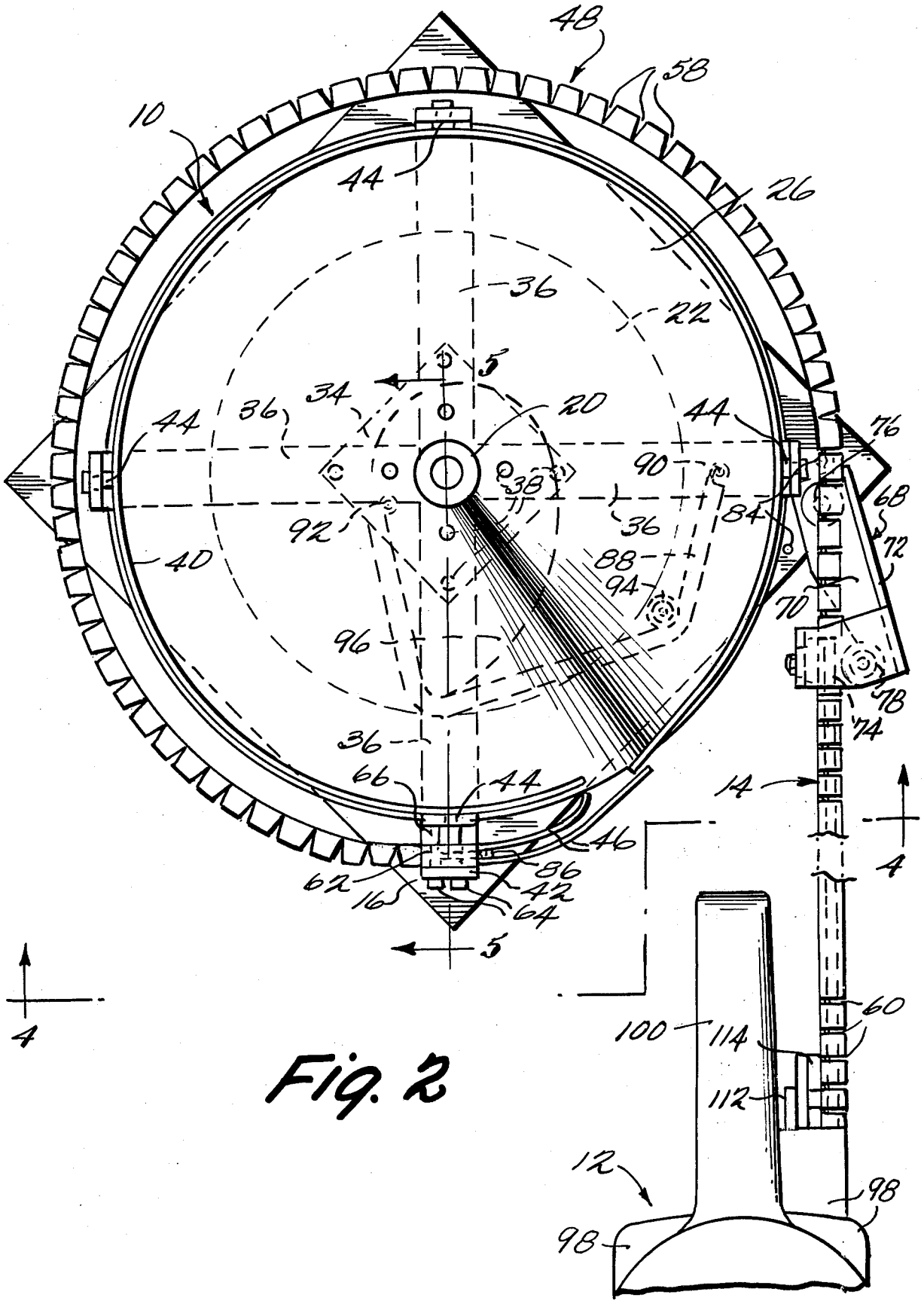
FIG. 2 is an enlarged fragmentary top plan view of the apparatus shown in FIG. 1.
Figure 4:
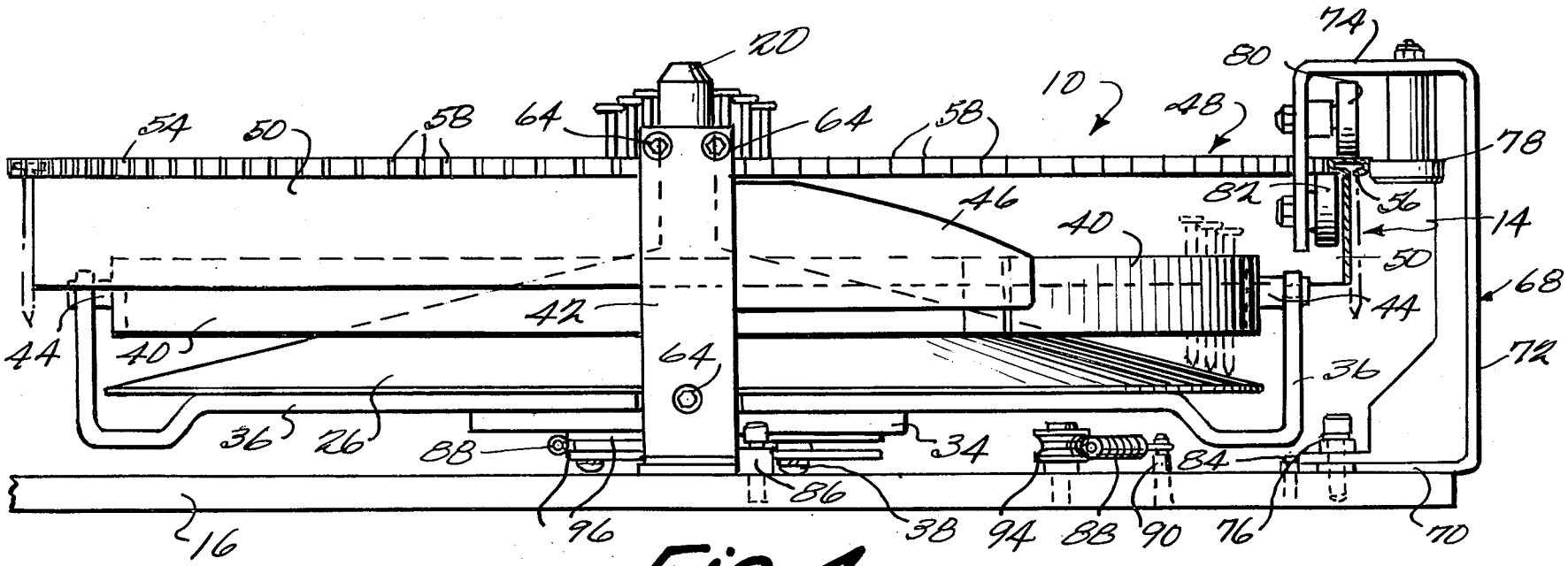
FIG. 4 is an enlarged fragmentary sectional view taken along the line 4—4 of FIG. 2.
Figure 5:
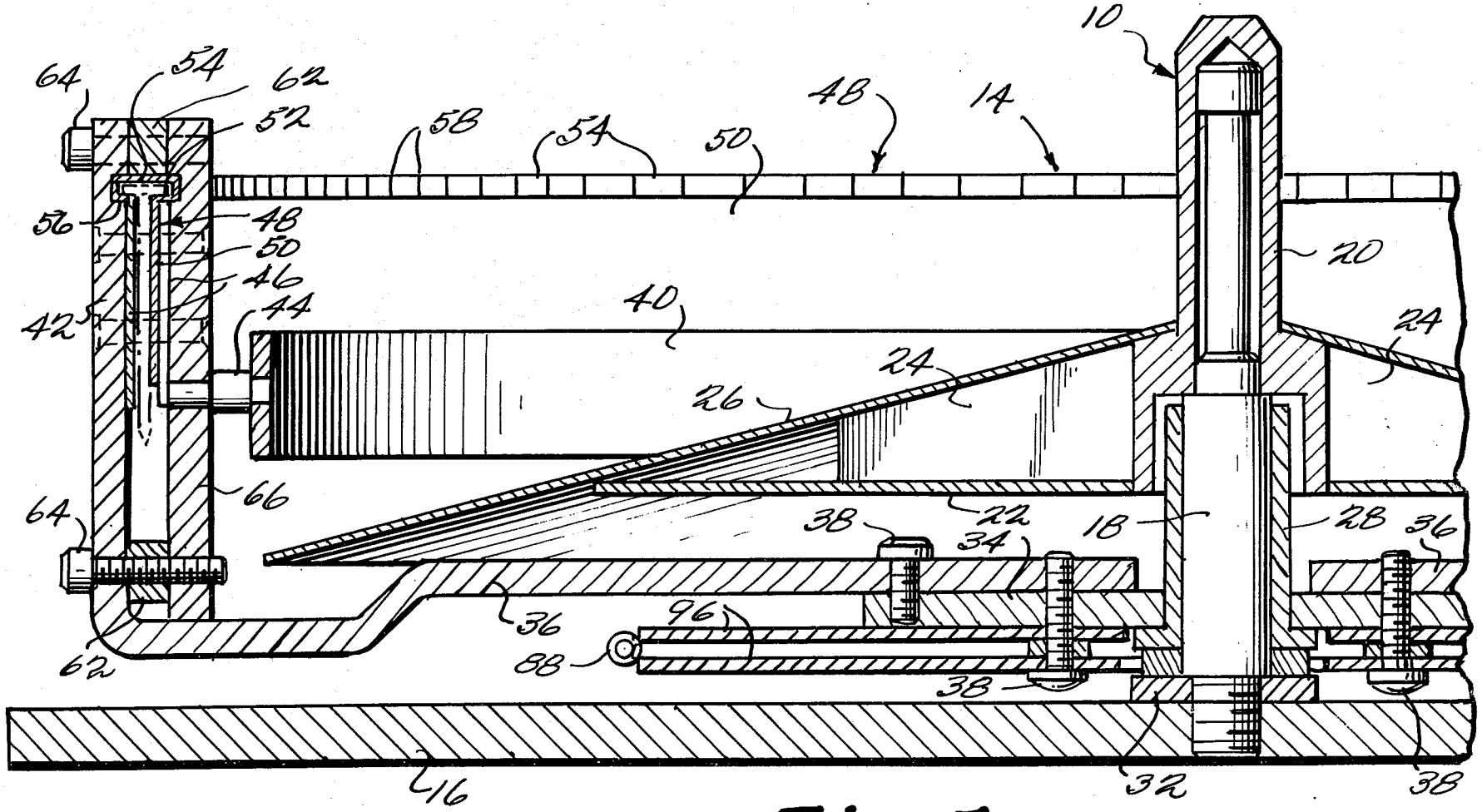
FIG. 5 is an enlarged fragmentary sectional view taken along the line 5—5 of FIG. 2.

Referring now more particularly to FIGS. 2, 4 and 5, there is shown therein a preferred embodiment of the package supporting assembly 10 and the cooperative connection of the bridge assembly 14 therewith. As shown, the package supporting assembly 10 includes a main base plate 16 of generally rectangular configuration having a threaded central opening therein for receiving the lower threaded end of a fixed vertically extending shaft 18. The shaft includes an upper end portion of reduced diameter on which is journaled a bushing or spindle 20. As best shown in FIG. 5, the lower end of the bushing is fixed, as by welding or the like, to the center of a disk 22 which is reinforced by a series of annularly spaced generally triangular gusset plates 24. Mounted on the disk 22 and gusset plate 24 assembly is a frustoconical wall 26 forming a rotary tray for engaging the points of the nails of a conical fastener package as disclosed above. The upper end portion of bushing 20 which rotates with the tray 26 serves as a guide for entering the open center of the package. A virgin fastener package is engaged in supported relation on the bushing 20 and tray 26 by a simple lowering movement. When once the points of the nails engage the surface of the tray, the package is supported for rotational movement about the axis of the shaft 18, which, by virtue of the engagement of the bushing 20 within the open center of the package, coincides with the axis of the coiled package.

The connection between the package supporting assembly 10 and the bridge assembly 14 includes means for controlling and handling the outer coil of the package supported on the tray 26. To this end, there is rotatably mounted on the lower end portion of the shaft 18, a flanged bushing 28, the lower surface of the flange of which engages a suitable annular bearing member 30, which, in turn, engages a washer 32 fixed to the central portion of the main base plate 16 by the shaft 18. Fixed to the upper surface of the flange of the bushing 28, as by welding, is a centrally apertured rectangular plate 34 having four annularly spaced radially extending L-shaped arm members 36 carried thereby. As shown, each L-shaped member 36 includes a horizontal leg portion which is fixed to the plate 34, as by a pair of bolt assemblies 38, and a vertical leg portion extending upwardly from the free outer end of the associated horizontal leg portion.

Three of the L-shaped members 36 are of identical configuration and serve to mount an outer coil engaging rail or arcuate plate 40 in a position above the lower outer surface of the rotary tray 26. The fourth L-shaped member 36 is provided with an extended vertical leg portion 42 which serves as a connecting means both for the rail 40 and the bridge assembly 14.

As best shown in FIG. 4, the rail member 40 is in the form of a flat strip of metal bent into an arcuate configuration throughout substantially its entire length except for a short end portion which is straight and extends tangentially outwardly in spaced relation to the opposite arcuate end portion thereof. Suitable rivet-like studs 44 serve to fix the rail to the vertical leg portions of the L-shaped members 36. The space between the ends of the rails 40 is positioned in generally closely spaced relation to the leg portion 42 and opens to a pair of guide plates 46 forming a part of the bridge assembly 14.

Figure 6:
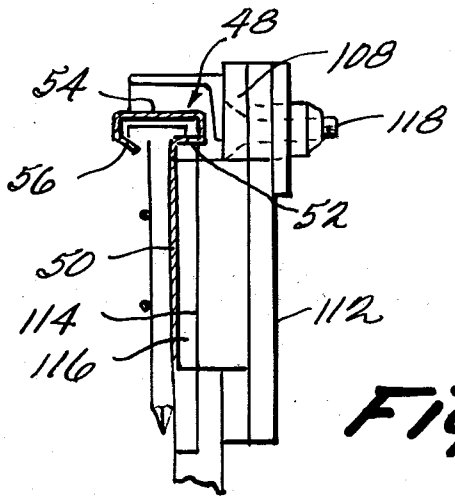
FIG. 6 is an enlarged fragmentary sectional view taken along the line 6—6 of FIG. 3.

As previously indicated, the bridge assembly 14 in its preferred embodiment as shown is structured to accommodate the wired nail fastener package previously described and, as such, consists essentially of an elongated guide track, generally indicated at 48, having a cross-sectional configuration to engage and guidingly support the nails of the package at positions beneath their heads on opposite sides of the shanks disposed in row formation. As best shown in FIGS. 4 - 6, the guide track 48 is formed of an elongated thin strip of metal bent along its length into a cross-sectional configuration which includes a vertically extending nail shank engaging section 50, a first nail head engaging section 52 extending horizontally therefrom, an inverted U-shaped connecting section 54 integrally interconnected at the free edge of one of its legs with the outer edge of the first nail head engaging section 52 and having a second nail head engaging section 56 extending horizontally inwardly from the free edge of the other leg thereof.

It will be noted that the angularly related sections 52, 54 and 56 serve to rigidify the vertically extending thin plate section 50 horizontally as well as render it stronger vertically. The longitudinal extent of the guide track 48 includes a main central portion which is maintained in its rigid form, a relatively long end portion adjacent the package support assembly 10 in which a multiplicity of closely spaced slots 58 are formed in the sections 52, 54 and 56 and extend slightly into the vertical section 50 to provide a limited degree of arcuate flexibility to the coextensive vertical section 50 thereof and a relatively short end portion adjacent the device 10 similarly slotted, as indicated at 60, to likewise provide a limited degree of flexibility to the coextensive vertical section 50 thereof.

The slots 58 are of a width and spacing such that when the associated flexible end portion of the guide track 48 is flexed into an arcuate configuration about the axis of rotation of the rotary structure made up of the bushing 28, plate 34, L-shaped members 36 and rail 40, the radially inner edges of the slots engage and prevent further arcuate flexure in a direction tending to make the radius of curvature shorter. Thus, with the flexible end portion of the guide track 48 disposed in the arcuately flexed position as shown in FIG. 2, the flexed portion acts as an arcuately rigid member such that with the associated end fixed to the rotary structure and the rigid portion extending tangentially from the arcuately flexed portion, a longitudinal pull on the rigid portion will result in a turning of the rotary structure in one direction (clockwise as viewed in FIG. 2).

The fixed connection of the associated end of the guide track 48 to the rotary structure is best shown in FIG. 5. As shown the inwardly facing surface of the leg portion 42 is grooved to receive the section 56 and associate portion of the section 54 of the guide track 48. An outer one of the guide plates 46 is fixedly secured, as by rivets or the like, to the inner face of the leg portion 42 so that its upper edge leads to the upper surface of the associated end of the track section 56. Mounted in fixed inwardly spaced relation with the leg portion 42, as by upper and lower spacer blocks 62 and bolts 64, is a mounting bar or plate 66 having its outwardly facing surface grooved similarly to the inner face of the leg portion 42. The groove receives the associated end of the section 52 and adjacent portion of the section 54 of the guide track 48. An inner one of the guide plates 46 is mounted on the outer face of the bar 66 with its upper edge leading to the upper surface of the end of the guide track section 52. The connection is completed by fixedly securing, as by rivets or the like, the associated end of the vertical section 50 of the guide track in outwardly facing relationship to the inner guide plate 46 and to the mounting bar 66. Finally, it will be noted that the associated stud 44 connects the associated portion of the rail 40 to the mounting bar 66 rather than directly to the leg portion 42, as is the case with the other three L-shaped members 36.

The portion of the guide track 48 extending tangentially from the arcuately flexed portion is supported and guided for longitudinal movement in opposite directions and for limited horizontal swinging movement by a pivoted support and guide structure, generally indicated at 68. As best shown in FIGS. 2 and 4, the pivoted structure 68 consists essentially of an arm formed of a metal plate bent to provide a lower horizontal base section 70, a vertical section 72 extending upwardly along one edge thereof, and an L-shaped upper section 74 extending horizontally from the upper outer edge thereof in the direction of extent of the base section 70 and then vertically downwardly. The lower section 70 is pivotally mounted on the base plate 16 by a vertically extending pivot pin assembly 76, in the position shown in FIG. 2. The L-shaped section 74 has three rollers, 78, 80 and 82, rotatably carried thereby in positions such that the periphery of the roller 78 engages the guide track 48 along the leg of the inverted U-shaped section 54 adjacent nail engaging section 56, the periphery of the roller 80 engages the bight portion of the inverted U-shaped section 54 and the periphery of the roller 82 engages beneath the section 52. In this way, the guide track 48 is supported and guided by the engagement of the rollers 78, 80 and 82 so that it can move only in either longitudinal direction with respect to the rollers with the limited horizontal swinging movement being accommodated by the pivoting of the structure 68 on which the rollers are mounted about pivot 76. The limits of the pivotal movement of the pivotal structure 68 are provided by any suitable means, such as a pair of stop pins 84 fixed in the base plate 16 at positions (see FIG. 2) to be engaged by the base sections 70.

The rotary structure to which the end of the guide track is fixed is preferably resiliently biased to move in a counterclockwise direction as viewed in FIG. 2 toward the limiting position shown therein. In the limiting position the juncture between the vertical leg portion 42 and the other leg of the L-shaped member serves as a stop surface which engages an abutment 86 fixed to the base plate 16. The resilient bias is provided by an elongated coil spring 88 of the tension type having one end thereof fixed to a pin 90 fixedly carried by the base plate 16 and the opposite end thereof fixed to the rotary structure, as indicated at 92 (see FIG. 2). In order to modify the spring force characteristics of the spring 88 so that the resilient bias applied is relatively constant throughout a range of movement of the rotary structure away from its limiting position, an intermediate portion of the coil spring 86 is engaged around a roller 94 mounted on the base plate 16 for rotation about a vertical axis. The end portion of the spring 88 extending from the fixed connection 92 is engaged with the periphery of a pair of cam plates 96 suitably fixed to the rotary structure. As shown, the cam plates 76 are fixed in spaced relation below the plate 34 of the rotary structure by utilizing suitable spacer blocks and the inner ones of the pairs of bolts 38.

As previously indicated, the preferred fastener driving device 12 shown is particularly adapted to drive fasteners from a package of the preferred type shown. It will be understood that the present invention contemplates other known fastener driving devices of the type adapted to drive fasteners contained in other package forms. Consequently, a detailed understanding of the interior construction and operation of the device 12 (see the U.S. patents previously referenced) is not believed essential to an understanding of the principles of the present invention. For present purposes it is sufficient to note that the device 12 includes a portable housing 98 having the usual handle 100 adapted to be gripped by the operator for the purpose of enabling the operator to manually handle the device. The housing 98 includes the usual nosepiece within which is defined a fastener drive track 102. The drive track 102 is laterally open to receive a leading fastener fed thereto by a fastener feeding mechanism 104, which, as shown, is in the form of a ratcheted turret cycled by the operator engaging the device onto the workpiece. It may be desirable to utilize a power driven fastener feeding mechanism in lieu of the manually actuated turret mechanism, an example of which is disclosed in U.S. Pat. No. 3,708,097.

The device 12 also includes the usual fastener driving element 106 slidable in the drive track which is in the form of a piston rod extending from a piston moved through an operative cycle including a drive stroke by a power source in the form of air under pressure.

The connection between the housing 98 of the device 12 and the adjacent end of the guide track 48 should meet several functional criteria. It must connect the end of the guide track 48 in supported relation with the device 12 so that the manual movements imparted to the device 12 by the operator will be likewise imparted to the end of the guide track 48. It must provide for the transitional guidance of the leading portion of the fastener package outwardly of the adjacent end of the guide track 48 and into cooperative relation with the fastener feeding mechanism 104. Preferably it should provide the above two functions in conjunction with the provision for a limited degree of flexible movement between the device and the guide track.

Figure 7:
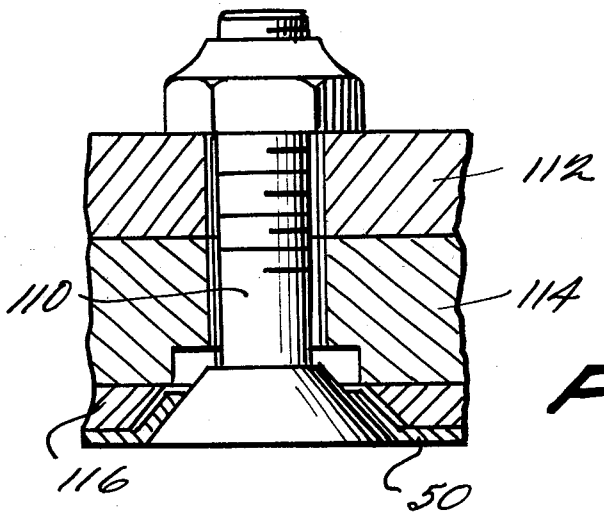
FIG. 7 is an enlarged fragmentary sectional view taken along the line 7—7 of FIG. 3.

As best shown in FIGS. 3, 6 and 7, the preferred connection is formed by simply removing the magazine cannister ordinarily provided on the device, as disclosed in the aforesaid patents, by loosening and removing the two bolts which hold the same on and replacing the magazine cannister with a pivot plate or bracket 108 utilizing the same two bolts and a suitable spacer block. The end of the guide track 48 is connected, as by bolts or rivets 110 to an inner cooperative pivot plate or bracket 112, an intermediate spacer block 114 and an outer stop plate 116. Pivot plate 112 is pivotally interconnected with pivot plate 108 by a horizontal pivot pin 118. The upper and lower surfaces of stop plate 116 engage horizontal surfaces on the housing 98 to limit the extent of vertical swinging movement about horizontal pivot pin 118. The slots 60 provide a limited degree of horizontal swinging movement.

OPERATION

FIG. 1 illustrates a typical preferred operational setup of the present apparatus. Depicted in FIG. 1 is a work station where workpieces to be nailed are moved through a limited space where the fasteners are driven therein by the device 112 while being manually handled by an operator. The fastener package supporting assembly 10 is mounted at a location spaced horizontally from the limited space within which the operator is to manually handle the device 12. In the pictorial representation illustrated in FIG. 1, the package support assembly 10 is mounted on a wheeled cabinet or the like. The bridge assembly 14 extends across the aforesaid horizontal space. As shown, with one end of the guide track 48 connected to the fastener driving device 12, the operator can, by grasping the handle of the device, effect the manual handling movements of the device necessary to drive the fasteners from the device 12 in the usual manner of operating the device. As the device 12 is manually moved by the operator, the associated end of the guide track 48 will be moved commensurately, with the pivot pin 118 providing for a limited articulation in a horizontal plane and the slots 60 providing a limited articulation in a horizontal plane. The natural flexure of the elongated extent of the guide track will permit a certain amount of angular movement of the device 12 although such movement is not needed to effect the necessary fastener driving actions in the embodiment illustrated.

It will be noted that the operator can move the device horizontally in a direction longitudinally outwardly of the guide track 48 as well as in either direction laterally with respect to the longitudinal direction. This enables the operator to manually handle the device 12 within the limited space so as to effect a desired number of operations. For example, it will be noted that as the device is moved by the operator in a direction longitudinally outwardly, the rotary structure which serves to mount the opposite end of the guide track 48 will be moved rotationally in a clockwise direction as viewed in FIG. 2. This movement will have the effect of turning the rotary structure which includes the arcuate rail 40. Such movement will pull on the outer coil of the fastener package supported on the rotary tray thus turning the rotary tray in conjunction with the turning of the rotary structure. During this turning movement, the coil spring 88 will be tensioned by virtue of the engagement of the cam plates 96 therewith so that when the movement force is relieved by the operator, the guide track 48 and associated rotary structure will be returned under the resilient bias of the spring to the limiting position shown in FIG. 2. During this movement, the outer coil of the package will simply uncoil from the main body of the package rather tha the movement resulting in a reverse pivotal movement of the rotary tray supporting the package.

It will be noted that any movement imparted to the device 12 by the operator resulting in an outward movement of the guide track 48 will be occasioned by a turning movement of the rotary structure supporting the rear end of the guide track. It will also be noted that at any position of such movement; the operator is readily enabled to actuate the device 12 to cycle the device including the fastener feed mechanism 104. The fastener feed mechanism 104 serves to move the entire leading length of the fastener package extending from the rotary tray to the drive track 102 of the device 12, irrespective of the position of the rotary structure supporting the rear end of the drive track 48.

It is important to note that by virtue of the support of the end of the guide track 48 provided by the rotary structure and the pivoted bracket 68, the operator need support only a proportionate share of the guide track and length of the fastener package supported therein since the other proportionate share is carried by an independent support at the location of the package support assembly 10. By limiting the length of the rigid portion of the guide track 48, the proportionate weight which the operator must manually handle in operating the device 12 can be limited to that which heretofore was regarded to be practical. Thus, with the present arrangement, the operator is enabled to utilize the device 12 within a limited space containing workpieces in a manner precisely the same as devices of this type were utilized heretofore. However, by the combination of the package support assembly 10 and the bridge assembly 14 with the device 12, such operation can be continued without reloading due to fastener package depletion for a number of times in excess of ten-fold that which heretofore could be accomplished.

It will be understood that while the apparatus of the present invention is particularly suited for enabling the device 12 to be operated manually in the manner indicated above, the arrangement is suitable for other types of operation is, for example, fixture set-ups and the like where either movement of the device is contemplated in the operation of the fixture, or the device is fixed in operation but relatively frequent changes of location of the device within the set-up are contemplated.

It thus will be seen that the objects of this invention have been fully and effectively accomplished. It will be realized, however, that the foregoing preferred specific embodiment has been shown and described for the purpose of illustrating the functional and structural principles of this invention and is subject to change without departure from such principles. Therefore, this invention includes all modifications encompassed within the spirit and scope of the following claims:

What is claimed is:

1. Apparatus for driving successive fasteners from a package of generally parallel fasteners flexibly serially interconnected in general row formation having a total virgin package weight greatly in excess of that which could be practically manually handled, said apparatus comprising:

a portable power operated fastener driving device comprising a housing including a handle operable to be grasped by an operator to enable the operator to manually handle the device within a workpiece containing limited space, means carried by said housing defining a fastener drive track, means carried by said housing for engaging a leading portion of a fastener package and feeding successive leading fasteners laterally into said drive track, and power operated means carried by said housing for driving successive leading fasteners fed to said drive track longitudinally outwardly thereof into a workpiece contained in said limited space, means for supporting a package of fasteners as aforesaid at a location spaced horizontally from the limited space within which the device is to be manually handled, movable elongated bridge means of a horizontal extent sufficient to extend from the location of said package supporting means to the limited space within which the device is to be manually handled, said movable bridge means having fastener package engaging means for receiving at one end of said bridge means a leading length of serially interconnected fasteners in row formation from the package supported by said package supporting means and for supporting the same for movement in the direction of extent of the row formation along the longitudinal extent of said elongated bridge means from said one end thereof outwardly of the other end thereof, means connecting the other end of said movable bridge means in supported relation with respect to said device housing for movement thereof in response to the manual handling movement of the device within said limited space with the fastener package engaging means of said bridge means disposed to guide the leading portion of the leading length of the fastening package outwardly of said other end and into cooperating relation with the fastener feeding means of said device, and means for supporting said one end of said movable bridge means for movement in a horizontal direction while maintaining the same in cooperating relation with said package supporting means with the one end of said package engaging means disposed to receive the leading length of the fastener package supported by said package supporting means in such a way as to accommodate any movements imparted to the other end of said movable bridge means by the manual handling movements of said device whereby such manual handling movements can be accomplished by the operator while supporting only a proportionate share of the weight of the bridge means and leading length of the fastener package supported thereon.

2. Apparatus for driving successive fasteners from a coiled package of generally parallel fasteners flexibly serially interconnected in general row formation having a total virgin package weight greatly in excess of that which could be practically manually handled, said apparatus comprising:

a portable power operated fastener driving device comprising a housing including a handle operable to be grasped by an operator to enable the operator to manually handle the device within a workpiece containing limited space, means carried by said housing defining a fastener drive track, means carried by said housing for engaging a leading portion of a fastener package and feeding successive leading fasteners laterally into said drive track, and power operated means carried by said housing for driving successive leading fasteners fed to said drive track longitudinally outwardly thereof into a workpiece contained in said limited space, a rotary tray for supporting a coiled package of fasteners for rotation generally about the axis of the coiled package at a location spaced horizontally from the limited space within which the device is to be manually handled, movable elongated bridge means of a horizontal extent sufficient to extend from the location of said package supporting means to the limited space within which the device is to be manually handled, said movable bridge means having fastener package engaging means for receiving at one end of said bridge means a leading length of serially interconnected fasteners in row formation from the package supported by said package supporting means and for supporting the same for movement in the direction of extent of the row formation along the longitudinal extent of said elongated bridge means from said one end thereof outwardly of the other end thereof, means connecting the other end of said movable bridge means in supported relation with respect to said device housing for movement thereof in response to the manual handling movement of the device within said limited space with the fastener package engaging means of said bridge means disposed to guide the leading portion of the leading length of the fastening package outwardly of said other end and into cooperating relation with the fastener feeding means of said device, and means for supporting said one end of said movable bridge means in cooperating relation with said package supporting means with the one end of said package engaging means disposed to receive the leading length of the fastener package supported by said package supporting means in such a way as to accommodate any movements imparted to the other end of said movable bridge means by the manual handling movements of said device whereby such manual handling movements can be accomplished by the operator while supporting only a proportionate share of the weight of the bridge means and leading length of the fastener package supported thereon, said bridge means comprising an elongated guide track defining said fastener package engaging means for receiving at one end thereof the leading length of the coiled fastener package supported by said rotary tray and for supporting the same for movement in the direction of extent of the row formation along the longitudinal extent of said guide track from said one end thereof outwardly of the other end thereof, said guide track including a first arcuately flexible portion extending from said one end disposed in generally arcuately extending relation about the axis of rotation of said rotary tray, a rigid portion extending from said arcuately flexible portion in tangential relation to the arcuately positioned arcuately flexible portion and a second arcuately flexible portion extending from said other end.

3. Apparatus as defined in claim 2 wherein said guide track is formed of an elongated metal strip bent lengthwise to form a vertically extending nail shank engaging section, a first nail head engaging section extending generally horizontally outwardly from the upper edge of said shank engaging section, and inverted U-shaped section having the free edge of its legs integrally interconnected with the outer edge of said first nail head engaging section and a second nail head engaging section extending generally horizontally inwardly from the free edge of the other leg of said inverted U-shaped section.

4. Apparatus as defined in claim 3 wherein said arcuately flexible portions of said guide track are formed by providing a multiplicity of parallel transverse slots through said inverted U-shaped section and said first and second nail engaging sections.

5. Apparatus as defined in claim 4 wherein said means for supporting said one end of said bridge means includes a rotary structure mounted for independent rotation about an axis common to the axis of said rotary tray, said one end of said guide track being fixed in tangential relation to said rotary structure at a position above and outwardly of the outer upper surface of said tray, said rotary structure including an outer coil engaging rail extending arcuately above the outer upper surface of said tray and leading tangentially to said one end of said guide track.

6. Apparatus as defined in claim 5 wherein said rotary structure includes stop means engageable with a fixed abutment for limiting the movement of said rotary structure about its axis in one direction of movement, and spring means operatively connected with said rotary structure for resiliently biasing said rotary structure in said one direction so as to (1) normally bias the same into a limiting position wherein said stop means is disposed in engagement with the fixed abutment and (2) permit yielding movable of said rotary structure about its axis in the opposite direction in response to a longitudinally outward movement of the rigid portion of said guide track.

7. Apparatus as defined in claim 6 wherein said means for supporting said one end of said bridge means further includes a guide structure mounted for pivotal movement about an axis parallel with the axis of rotation of said rotary structure in annularly spaced relation with respect to the one end of said guide track, said guide structure including guide rollers engaging the portion of said guide track extending in tangential relation from the arcuately positioned portion thereof so as to support the same for longitudinal movement.

8. Apparatus as defined in claim 7 wherein said means connecting said other end of said bridge means includes a hinge-like structure providing limiting pivotal movement about a generally horizontal axis between said device housing and said other end of said guide track.

9. Apparatus as defined in claim 2 wherein said rotary tray includes an upright spindle for engaging within a central opening in the coiled package and a circular wall fixed to said spindle for supporting the pointed ends of the fastener package.

10. Apparatus as defined in claim 8 wherein said circular wall is frustoconical.

11. Apparatus as defined in claim 2 wherein said means for supporting said one end of said bridge means includes a rotary structure mounted for independent rotation about an axis common to the axis of said rotary tray, said one end of said guide track being fixed in tangential relation to said rotary structure at a position above and outwardly of the outer upper surface of said tray, said rotary structure including an outer coil engaging rail extending arcuately above the outer upper surface of said tray and leading tangentially to said one end of said guide track.

12. Apparatus as defined in claim 10 wherein said rotary structure includes stop means engageable with a fixed abutment for limiting the movement of said rotary structure about its axis in one direction of movement, and spring means operatively connected with said rotary structure for resiliently biasing said rotary structure in said one direction so as to (1) normally bias the same into a limiting position wherein said stop means is disposed in engagement with the fixed abutment and (2) permit yielding movable of said rotary structure about its axis in the opposite direction in response to a longitudinally outward movement of the rigid portion of said guide track.

13. Apparatus as defined in claim 11 wherein said means for supporting said one end of said bridge means further includes a guide structure mounted for pivotal movement about an axis parallel with the axis of rotation of said rotary structure in annularly spaced relation with respect to the end of said guide track, said guide structure including guide rollers engaging the portion of said guide track extending in tangential relation from the arcuately positioned portion thereof so as to support the same for longitudinal movement.

14. Apparatus as defined in claim 2 wherein said means connecting said other end of said bridge means includes a hinge-like structure providing limited pivotal movement about a generally horizontal axis between said device housing and said other end of said guide track.

15. Apparatus for enabling a portable power operated fastener driving device to be conveniently manually handled within a workpiece containing limited space with the fastener feeding means of said device operating on a package of generally parallel fasteners flexibly serially interconnected in general row formation, which package has a total virgin package weight greatly in excess of that which could be practically manually handled with the device, said apparatus comprising:

means for supporting a package of fasteners of the type aforesaid at a location spaced horizontally from the limited space within which the device is to be manually handled, movable elongated bridge means of a horizontal extent sufficient to extend from the location of said package supporting means to the limited space within which the device is to be manually handled, said movable bridge means having fastener package engaging means for receiving at one end of said bridge means a leading length of serially interconnected fasteners in row formation from the package supported by said package supporting means and for supporting the same for movement in the direction of extent of the row formation along the longitudinal extent of said elongated bridge means from said one end thereof outwardly to the other end thereof, means for connecting the other end of said movable bridge means in supported relation with respect to said device for movement thereof in response to the manual handling movement of the device within said limited space with the fastener package engaging means of said bridge means disposed to guide the leading portion of the leading length of the fastener package for movement outwardly of said other end and into cooperating relation with the fastener feeding means of said device, and means for supporting said one end of said movable bridge means for movement in a horizontal direction while maintaining the same in cooperating relation with said package supporting means with the one end of said package engaging means disposed to receive the leading length of the fastener package supported by said package supporting means in such a way as to accommodate any movements imparted to the other end of said movable bridge means by the manual handling movements of said device whereby such manual handling movements can be accomplished by the operator while supporting only a proportionate share of the weight of the bridge means and the leading length of the fastener package supported thereon.

16. Apparatus for enabling a portable power operated fastener driving device to be conveniently manually handled within a workpiece containing limited space with the fastener feeding means of said device operating on a coiled package of generally parallel fasteners flexibly serially interconnected in general row formation, which package has a total virgin package weight greatly in excess of that which could be practically manually handled with the device, said apparatus comprising;

a rotary tray for supporting a package of coiled fasteners for rotation generally about the axis of the coiled package at a location spaced horizontally from the limited space within which the device is to be manually handled, movable elongated bridge means of a horizontal extent sufficient to extend from the location of said package supporting means to the limited space within which the device is to be manually handled, said movable bridge means having fastener package engaging means for receiving at one end of said bridge means a leading length of serially interconnected fasteners in row formation from the package supported by said package supporting means and for supporting the same for movement in the direction of extent of the row formation along the longitudinal extent of said elongated bridge means from said one end thereof outwardly to the other end thereof, means for connecting the other end of said movable bridge means in supported relation with respect to said device for movement thereof in response to the manual handling movement of the device within said limited space with the fastener package engaging means of said bridge means disposed to guide the leading portion of the leading length of the fastener package for movement outwardly of said other end and into cooperating relation with the fastener feeding means of said device, and means for supporting said one end of said movable bridge means in cooperating relation with said package supporting means with the one end of said package engaging means disposed to receive the leading length of the fastener package supported by said package supporting means in such a way as to accommodate any movements imparted to the other end of said movable bridge means by the manual handling movements of said device whereby such manual handling movements can be accomplished by the operator while supporting only a proportionate share of the weight of the bridge means and the leading length of the fastener package supported thereon, said bridge means comprising an elongated guide track defining said fastener package engaging means for receiving at one end thereof a leading length of the coiled fastener package supported by said rotary tray and for supporting the same for movement in the direction of extent of the row formation along the longitudinal extent of said guide track from said one end thereof outwardly of the other end thereof, said guide track including an arcuately flexible portion extending from said one end disposed in generally arcuately extending relation about the axis of rotation of said rotary tray and a rigid portion extending from said arcuately flexible portion in tangential relation to the arcuately positioned arcuately flexible portion.

17. Apparatus as defined in claim 16 wherein said guide track is formed of an elongated metal strip bent lengthwise to form a vertically extending nail shank engaging section, a first nail head engaging section extending generally horizontally outwardly from the upper edge of said shank engaging section, an inverted U-shaped section having the free edge of one of its legs integrally interconnected with the outer edge of said first nail head engaging section and a second nail head engaging section extending generally horizontally inwardly from the free edge of the other leg of said inverted U-shaped section.

18. Apparatus as defined in claim 17 wherein said arcuately flexible portion of said guide track is formed by providing a multiplicity of parallel transverse slots through said inverted U-shaped section and said first and second all engaging sections.

19. Apparatus as defined in claim 16 wherein said rotary tray includes an upright spindle for engaging within a central opening in the coiled package and a frustoconical wall for supporting the pointed ends of the fastener package.

20. Apparatus as defined in claim 16 wherein said means for supporting said one end of said bridge means includes a rotary structure mounted for independent rotation about an axis common to the axis of said rotary tray, said one end of said guide track being fixed in tangential relation to said rotary structure at a position above and outwardly of the outer upper surface of said track, said rotary structure including an outer coil engaging rail extending arcuately above the outer upper surface of said track and leading tangentially to said one end of said guide track.

21. Apparatus as defined in claim 20 wherein said rotary structure includes stop means engageable with a fixed abutment for limiting the movement of said rotary structure about its axis in one direction of movement, and spring means operatively connected with said rotary structure for resiliently biasing said rotary structure in said one direction so as to (1) normally bias the same into a limiting position wherein said stop means is disposed in engagement with the fixed abutment and (2) permit yielding movable of said rotary structure about its axis in the opposite direction in response to a longitudinally outward movement of the rigid portion of said guide track.

22. Apparatus as defined in claim 21 wherein said guide track mounting means further includes a guide structure mounted for pivotal movement about an axis parallel with the axis of rotation of said rotary structure in annularly spaced relation with respect to the one end of said guide track, said guide structure including guide rollers engaging the portion of said guide track extending in tangential relation from the arcuately positioned portion thereof so as to support the same for longitudinal movement.

23. Apparatus for handling a large capacity coiled package of generally parallel fasteners flexible serially interconnected in general row formation comprising means for supporting a coiled package as aforesaid for rotation generally about the axis of the coiled package, and an elongated guide track for receiving at one end thereof a leading length of serially interconnected fasteners in row formation from the package supported by said package supporting means and for supporting the same for movement in the direction of extent of the row formation along the longitudinal extent of said guide track from said one end thereof outwardly of the other end thereof, said guide track including an arcuately flexible portion extending from said one end disposed in generally arcuately extending relation about the axis of rotation of a package supported on said package supporting means and a rigid portion extending from said arcuately flexible portion in tangential relation to the arcuately positioned arcuately flexible portion, and means for mounting said guide track for movement with respect to said package supporting means so that said one end moves arcuately about the axis of a package supported on said package supporting means at a position radially outwardly of the outer coil thereof in response to a longitudinal movement of the rigid portion of said guide track.

24. Apparatus as defined in claim 23 wherein said guide track is formed of an elongated metal strip bent lengthwise to form a vertically extending nail shank engaging section, a first nail head engaging section extending generally horizontally outwardly from the upper edge of said shank engaging section, an inverted U-shaped section having the free edge of one of its legs integrally interconnected with the outer edge of said first nail head engaging section and a second nail head engaging section extending generally horizontally inwardly from the free edge of the other leg of said inverted U-shaped section.

25. Apparatus as defined in claim 24 wherein said arcuately flexible portion of said guide track is formed by providing a multiplicity of parallel transverse slots through said inverted U-shaped section and said first and second nail engaging sections.

26. Apparatus as defined in claim 23 wherein said package supporting means includes an upright spindle for engaging within a central opening in the coiled package and a circular wall for supporting the pointed ends of the fastener package.

27. Apparatus as defined in claim 26 wherein said spindle and circular wall are fixedly interconnected and mounted for rotation about an axis concentric to both.

28. Apparatus as defined in claim 27 wherein said circular wall is frustoconical.

29. Apparatus as defined in claim 23 wherein said guide track mounting means includes a rotary structure mounted for independent rotation about an axis common to the axis of said spindle and circular well, said one end of said guide track being fixed in tangential relation to said rotary structure at a position above and outwardly of the outer upper surface of said circular wall, said rotary structure including an outer coil engaging rail extending arcuately above the outer upper surface of said circular wall and leading tangentially to said one end of said guide track.

30. Apparatus as defined in claim 29 wherein said rotary structure includes stop means engageable with a fixed abutment for limiting the movement of said rotary structure about its axis in one direction of movement, and spring means operatively connected with said rotary structure for resiliently biasing said rotary structure in said one direction so as to (1) normally bias the same into a limiting position wherein said stop means is disposed in engagement with the fixed abutment and (2) permit yielding movable of said rotary structure about its axis in the opposite direction in response to a longitudinally outward movement of the rigid portion of said guide track.

31. Apparatus as defined in claim 30 wherein said guide track mounting means further includes a guide structure mounted for pivotal movement about an axis parallel with the axis of rotation of said rotary structure in annularly spaced relation with respect to the one end of said guide track, said guide structure including guide rollers engaging the portion of said guide track extending in tangential relation from the arcuately positioned portion thereof so as to support the same for longitudinal movement.

* * * * *